US006173556B1

(12) United States Patent
Willard

(10) Patent No.: US 6,173,556 B1
(45) Date of Patent: Jan. 16, 2001

(54) SEED PACKET FILLING AND CLOSING MACHINE

(75) Inventor: Stephen F. Willard, Hebron, CT (US)

(73) Assignee: Stamprite, Bolton, CT (US)

( * ) Notice: Under 35 U.S.C. 154(b), the term of this patent shall be extended for 0 days.

(21) Appl. No.: 09/164,689

(22) Filed: Oct. 1, 1998

(51) Int. Cl.[7] ..... B65B 43/14

(52) U.S. Cl. ..... 53/571; 53/67; 53/247; 53/249; 53/260

(58) Field of Search ..... 53/570, 571, 573, 53/260–67, 247, 249

(56) References Cited

U.S. PATENT DOCUMENTS

| | | | | |
|---|---|---|---|---|
| 395,390 | * | 1/1889 | Hammersley | 53/573 |
| 1,909,319 | * | 5/1933 | Taylor | 53/571 |
| 2,272,251 | * | 2/1942 | Robinson | 53/455 |
| 2,923,111 | * | 2/1960 | Selock | 53/570 |
| 3,340,679 | * | 9/1967 | Johnson | 53/570 |
| 4,033,093 | * | 7/1977 | Menacci | 53/571 |
| 4,509,313 | * | 4/1985 | Koppe | 53/570 |
| 4,987,547 | * | 1/1991 | Rabindran | 53/284.3 |
| 5,174,088 | * | 12/1992 | Focke | 53/562 |
| 5,315,807 | * | 5/1994 | Restle | 53/51 |

* cited by examiner

*Primary Examiner*—John Sipos
(74) *Attorney, Agent, or Firm*—McCormick, Paulding & Huber LLP

(57) ABSTRACT

A machine for filling and closing seed packets has a conveyor system which includes first and conveyors, when continuously advance a succession of preformed seed packets. Packets are filled from a continuously rotating funnel wheel which receives seed from a vibratory feeder as the packets are advanced by the first conveyor. The second conveyor receives packets from the first conveyor and applies sealing pressure to the closing flaps on the packets as the packets are further advanced.

19 Claims, 9 Drawing Sheets

SEED PACKET FILLING AND CLOSING MACHINE

BACKGROUND OF INVENTION

This invention relates in general to packaging apparatus and deals more particularly with an improved seed packaging machine for filling and closing preformed seed packets.

Such seed packaging machines of the aforementioned type as have been heretofore available are generally complex mechanisms designed for low speed operation, operate with intermittent motion, and have large numbers of moving parts. Such machines are generally expensive to produce, operate and maintain, are subject to heavy wear, and usually require frequent adjustment, which adds substantially to machine operating cost.

Accordingly, it is the general aim of the present invention to provide an improved seed packet filling and closing machine which may be produced at relatively low cost, and which is designed for continuous high speed, maintenance free operation. It is a further aim of the invention to provide a machine which may be readily adjusted by an operator having ordinary skill to accommodate frequent changes in seed feeding requirements with minimal machine downtime.

SUMMARY OF THE INVENTION

In accordance with the present invention an apparatus is provided for filling and closing preformed seed packets which have front and rear panels connected together along bottom and side edges, an upwardly open mouth and an upwardly extending closure flap connected to an upper edge of one of the panels. The apparatus comprises a supply magazine for containing a quantity of packets, packet feeding means for withdrawing each successive packet from the supply magazine and disposing it in a pick-up position, first conveying means for engaging each successive packet at the pick-up position, gripping an associated lower portion of the packet, and continuously advancing the packet along a predetermined path to and through a packet filling station. A packet opening means mounted in fixed position along the predetermined path opens the packet as the packet advances along the predetermined path to the filling station. Seed dispensing means at the filling station load a predetermined quantity of seed into the packet through the mouth thereof as the packet is advanced along the predetermined path through the filling station. A packet closing means is provided for closing the closure flap as the packet is further advanced along the predetermined path from the packet filling station.

DETAILED DESCRIPTION OF PREFERRED EMBODIMENT AND METHOD

Figure 1:
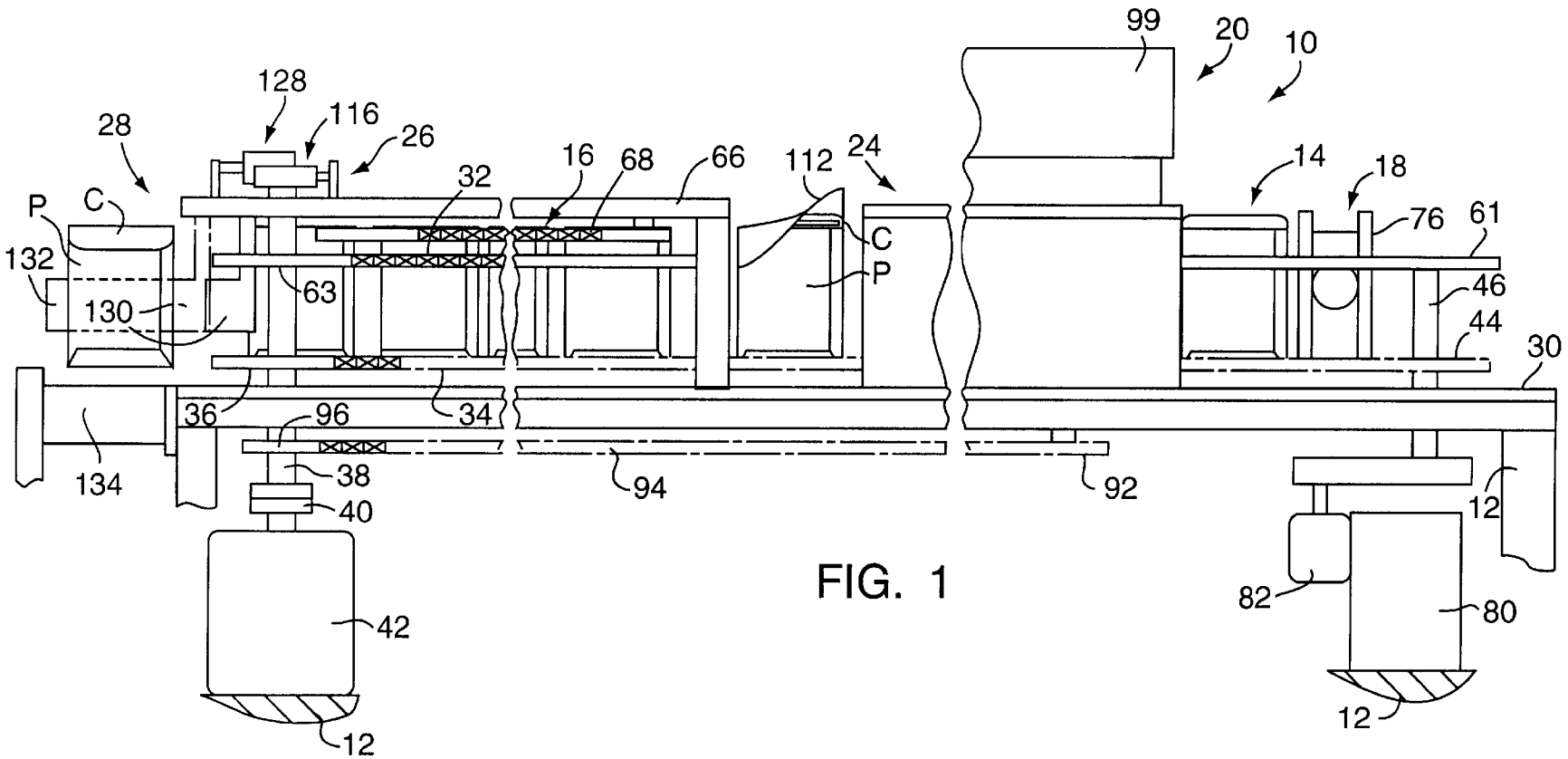
FIG. 1 is a front elevation of view of a seed packet filling and closing machine enbodying the present invention.

In the drawings and in the description which follows the present invention is illustrated and described with reference to a seed packet filling and closing machine embodying the invention and indicated generally by the numeral 10. The illustrated machine 10 is particularly adapted to fill and close standard preformed 3¼×4½ seed packets. However, modified versions of the machine may be provided to accommodate seed packets of other sizes.

Figure 4:
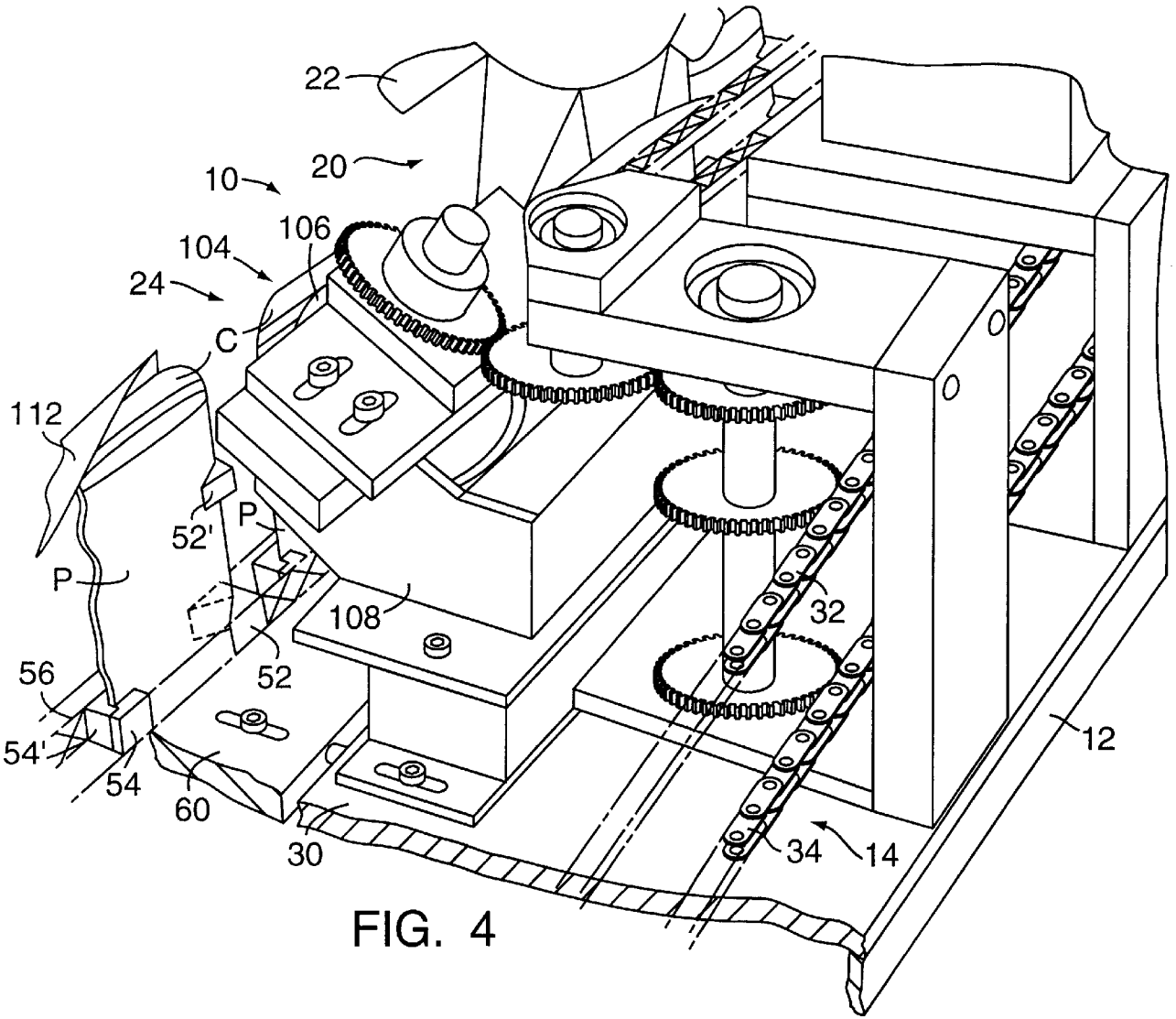
FIG. 4 is a somewhat further enlarged fragmentary perspective view showing a portion of the machine at the closing station.

The machine 10 shown in FIGS. 1 and 4 generally comprises a frame, indicated generally at 12, which supports a conveyor system. The conveyor system includes first and second conveyors generally indicated at 14 and 16, respectively, which cooperate to continuously move a succession of preformed seed packets along a predetermined path to and through successive work stations where packet filling, closing and marking operations are performed on the advancing packets. More specifically, the first conveyor 14 receives a succession of upwardly open seed packets at a packet feeding station 18, grips a lower portion of each successive seed packet and advances the packet to and through a packet filling station 20 where a continuously moving seed distributor 22 deposits a predetermined quantity of seed in the packet through the upwardly open mouth of the packet. The moving packet is further advanced by the first conveyor 14 from the packet filling station 20 to a closing station 24 where a closure flap on the packet is folded from an open to a closed position and sealed in the latter position. The second conveyor 16 receives the filled and closed packet from the first conveyor 14, grips an upper marginal portion of the moving packet, and urges the closure flap toward and holds the flap in sealed position while conveying the packet along a further portion of the predetermined path to a marking station 26 where code information or other indicia is or may be imprinted on the packet, after which the packet is ejected from the machine at a discharge station 28, all of which will be hereinafter more fully described. However, before describing the machine 10 in further detail, a preformed seed packet used with the machine will be briefly considered to aid in a further understanding of the machine and the manner in which the packet cooperates with the machine.

Figure 5:
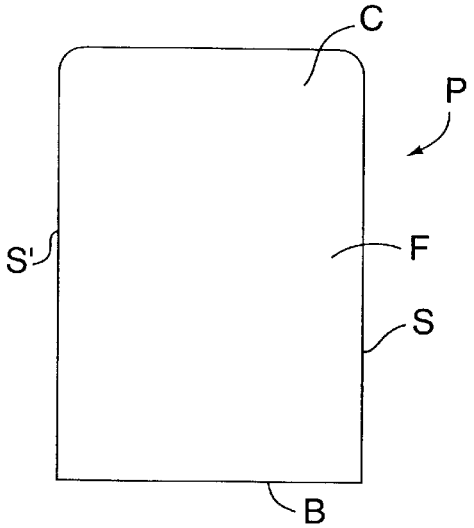
FIG. 5 is a somewhat enlarged front elevational view of a typical preformed seed packet used with the machine of the present invention.
Figure 6:
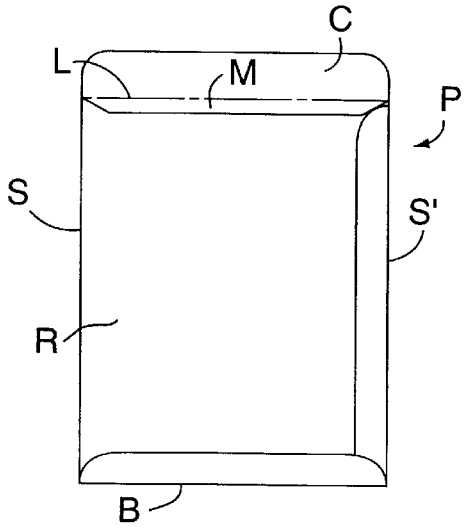
FIG. 6 is a rear elevational view of the seed packet shown in FIG. 5.

The construction of the seed packet may vary; however, a typical preformed seed packet used with the machine of the present invention and shown in FIGS. 5 and 6 essentially comprises a substantially flat paper envelope formed from a unitary blank and indicated generally by the letter P. The packet P has front and rear panels designated, respectively, by the letters F and R and joined together along a bottom edge B and side edges S, S'. The front and rear panels F and R cooperate to define an upwardly open mouth M. A closure flap C connected to an upper edge of the front panel F extends upwardly from the front panel when the packet is in an open condition for use with the machine 10, as hereinafter further discussed. The closure flap C is adapted to be folded from the aforesaid open position to a closed position wherein it overlies an upper portion of the rear panel R and, for this reason, the closure flap C is preferably connected to the front panel F along a preformed fold or score line indicated by the letter L. Although the presence of a fold line on the packet is not essential to the operation of the machine 10, the fold line is desirable, because it aids in assuring proper packet closure.

Considering now the illustrated machine 10 in further detail, and referring first particularly to FIGS. 1 and 4, the frame 12 essentially comprises a table-like structure and has a top or horizontal base plate 30. The conveyor system which includes the first and second conveyers 14 and 16 is mounted above the base plate 30 and comprises a plurality of endless conveyor chains supported by sprockets mounted on vertically upwardly extending shafts. The first conveyor 14 receives a succession of empty preformed seed packets P, P at the packet feeding station 18 and conveys each packet along an initial portion of a predetermined path through the machine 10. The first conveyor includes vertically spaced apart upper and lower conveyor chains disposed in horizontal planes and respectively indicated at 32 and 34. The lower conveyor chain 34 is driven by a main drive sprocket 36 keyed to a first or main drive shaft 38 which extends upwardly through the base plate. The lower end of the main drive shaft 38 is coupled by a friction clutch 40 to a DC drive motor 42 mounted on the frame 12 below the base plate 30 and near the front and the left hand or discharge end of the machine 10, as shown in FIG. 1.

The lower conveyor chain 34 drives a second drive sprocket 44 keyed to a second drive shaft 46, located near the right hand or input end of the machine 10, and is further supported by an idler sprocket and a pivotally mounted chain tensioning sprocket 50 biased toward a tensioning condition relative to the conveyor chain 34. The lower conveyor chain 34 carries a plurality of generally V-shaped flights 52,52 and generally L-shaped jaws 54, 54 arranged in spaced apart alternate series along the conveyor chain for engaging seed packets, as will be herein after further described.

Figure 2:
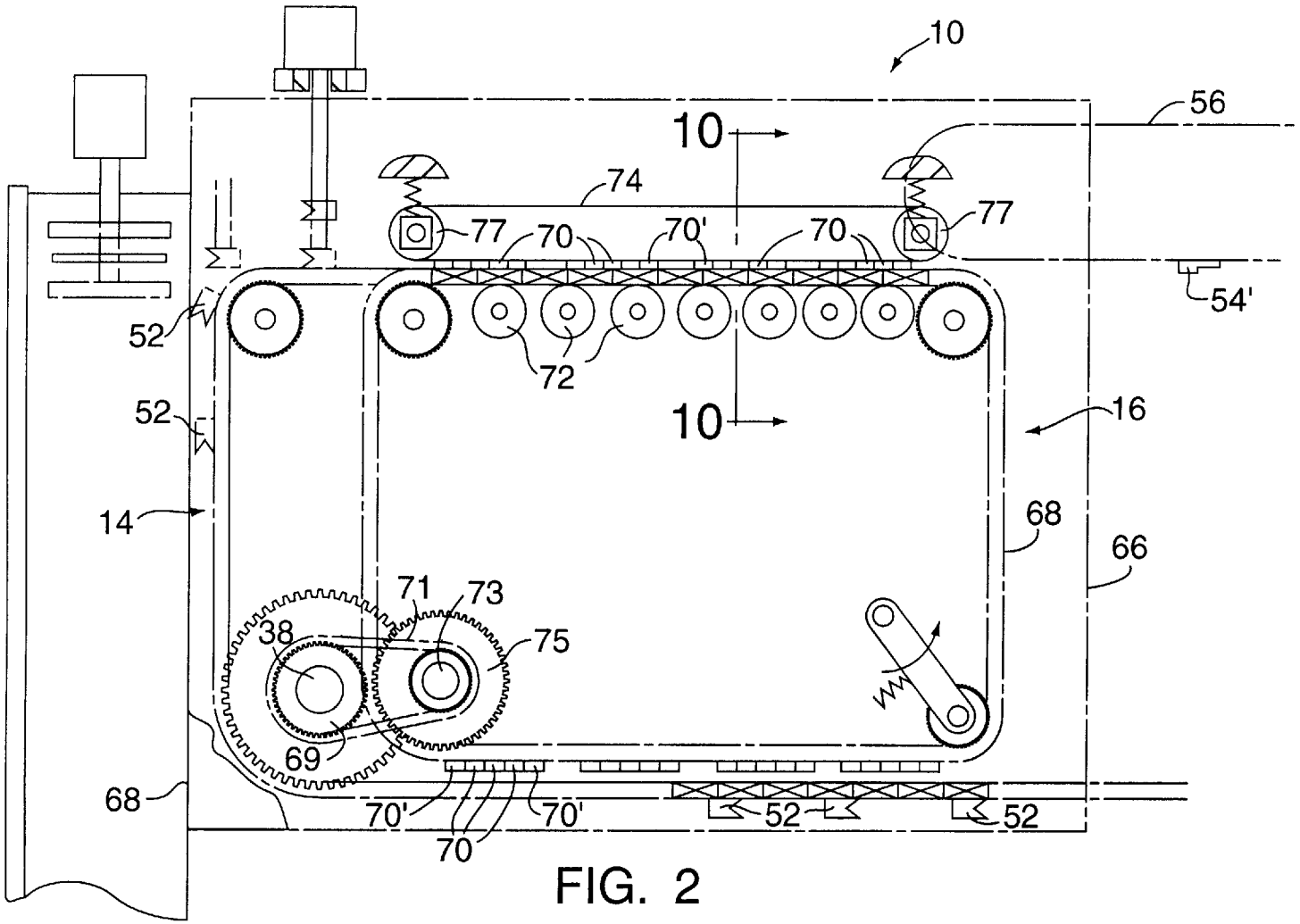
FIG. 2 is a somewhat enlarged fragmentary plan view showing the left-hand portion of the machine of FIG. 1.
Figure 3:
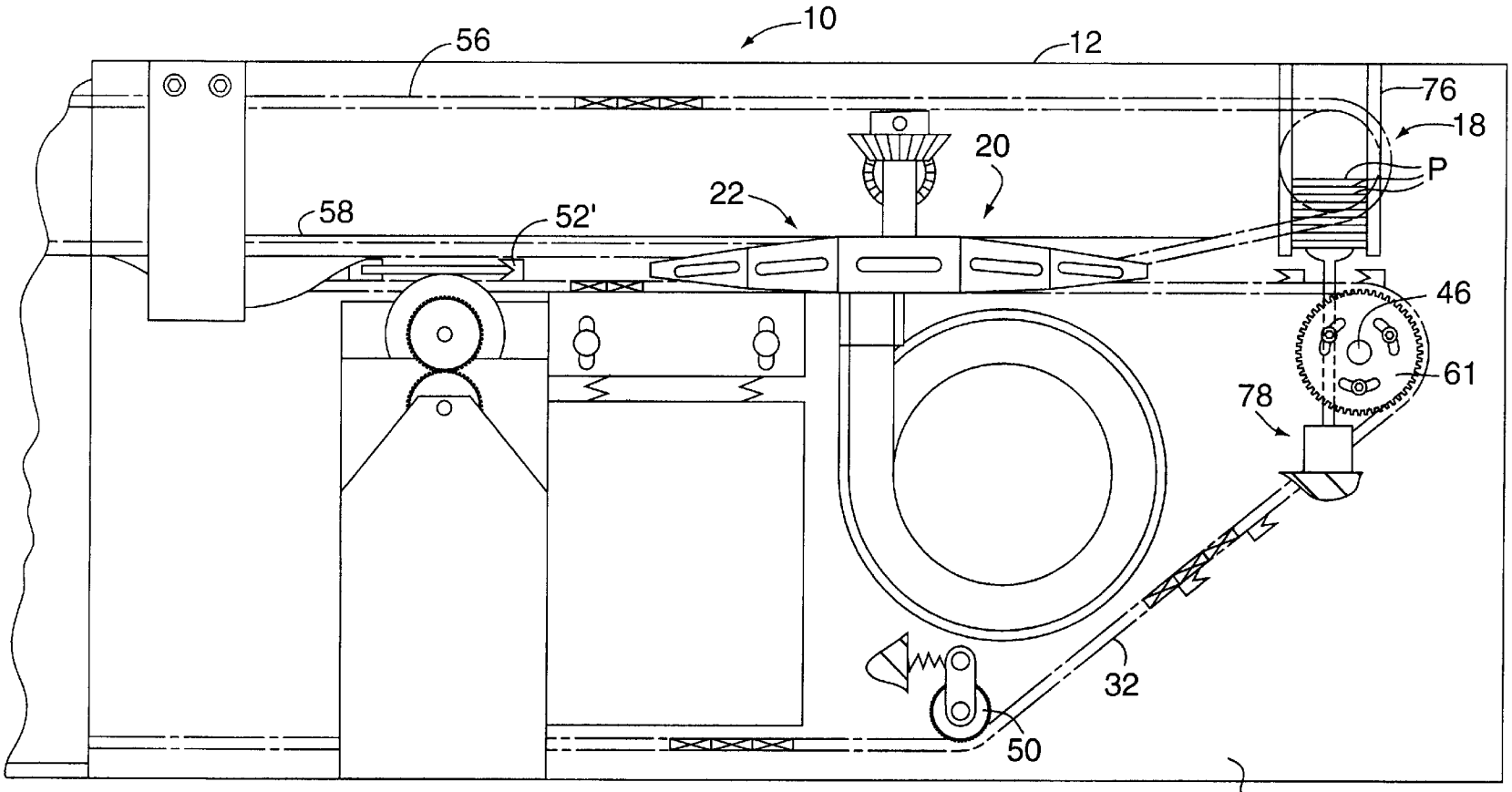
FIG. 3 is a somewhat enlarged fragmentary plan view showing the right-hand portion of the machine of FIG. 1.

The first conveyor 14 further includes an endless backup conveyor chain 56, best shown in FIGS. 2 and 3 and disposed rearwardly of and generally within a horizontal plane of the lower conveyor chain 34. The backup chain 56 is supported by a plurality of sprockets and travels along the frontal surface of a vertically disposed backup wall 58 mounted in fixed position on the base plate 30 immediately rearward of the lower conveyor chain 34. The backup chain 56 carries a plurality of L-shaped jaws 54', 54' for cooperating in generally complementary interlocking and gripping relation with the opposing L-shaped jaws 54, 54 on the lower conveyor chain 34. A spring biased pressure bar 60 (FIG. 8) mounted on the base plate 30 inwardly of the rear run of the lower conveyor chain 34 biases a portion of the lower conveyor chain toward the backup wall 58 whereby the gripping jaws 54, 54 on the lower conveyor chain 34 are biased toward complementary gripping engagement with associated opposing gripping jaws 54', 54' on the backup conveyor chain 56 generally along the entire length of the pressure bar 60.

The upper conveyor chain 32 is supported by a plurality of sprockets mounted on upper portions of the shafts which carry the sprockets supporting the lower conveyor chain 34. The upper conveyor chain 32 is a near mirror image of the lower conveyor chain 34 and carries a series of flights 52', 52', each flight 52' being vertically aligned with an associated flight 52 on the lower conveyor chain. However, unlike the lower conveyor chain 34, the upper conveyor chain 32 does not have gripping jaws. The upper conveyor chain 32 is driven by the lower conveyor chain 34 and more specifically by the second drive sprocket 44 and second drive shaft 46. A third drive sprocket 61 is mounted in fixed position on and angularly adjustable relative to the second drive shaft 46, to permit adjustment of the upper conveyor chain 32 relative to the lower conveyor chain 34 to bring each flight 52' on the upper chain into vertical alignment with an associated flight 52 on the lower conveyor chain. For this reason a sprocket 63 which supports the upper conveyor chain 34 on the main drive shaft 38 is angularly movable relative to the main drive shaft.

Figure 7:
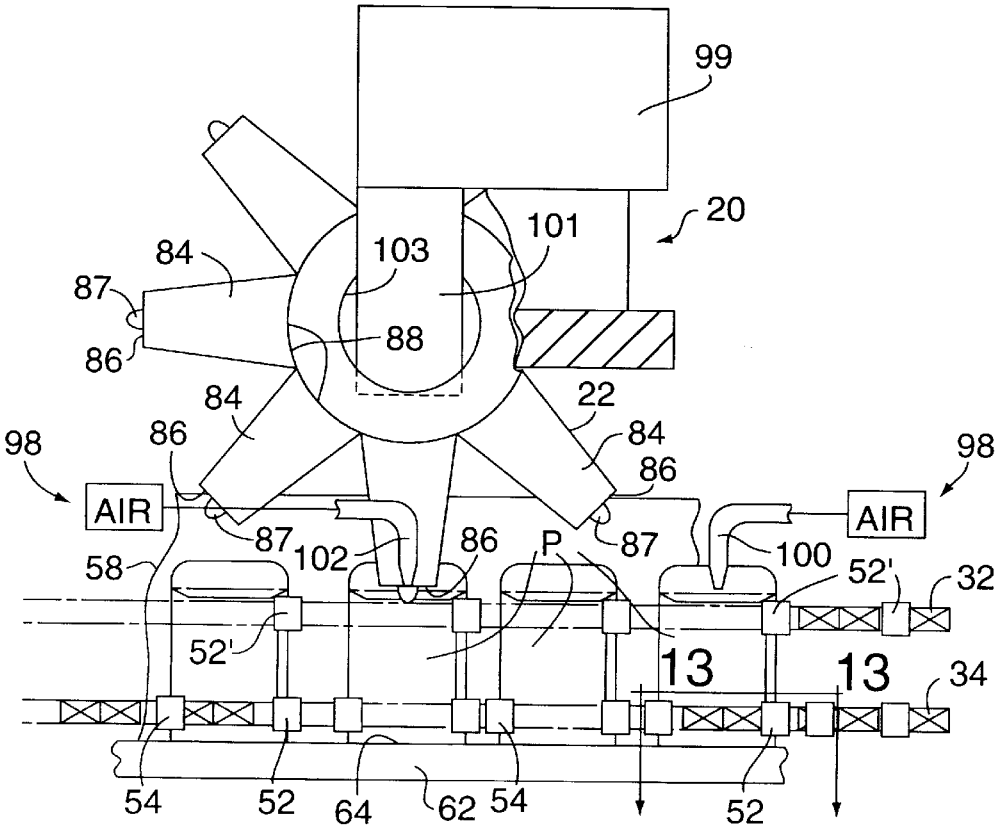
FIG. 7 is a somewhat schematic front elevational view of the packet filling station.
Figure 8:
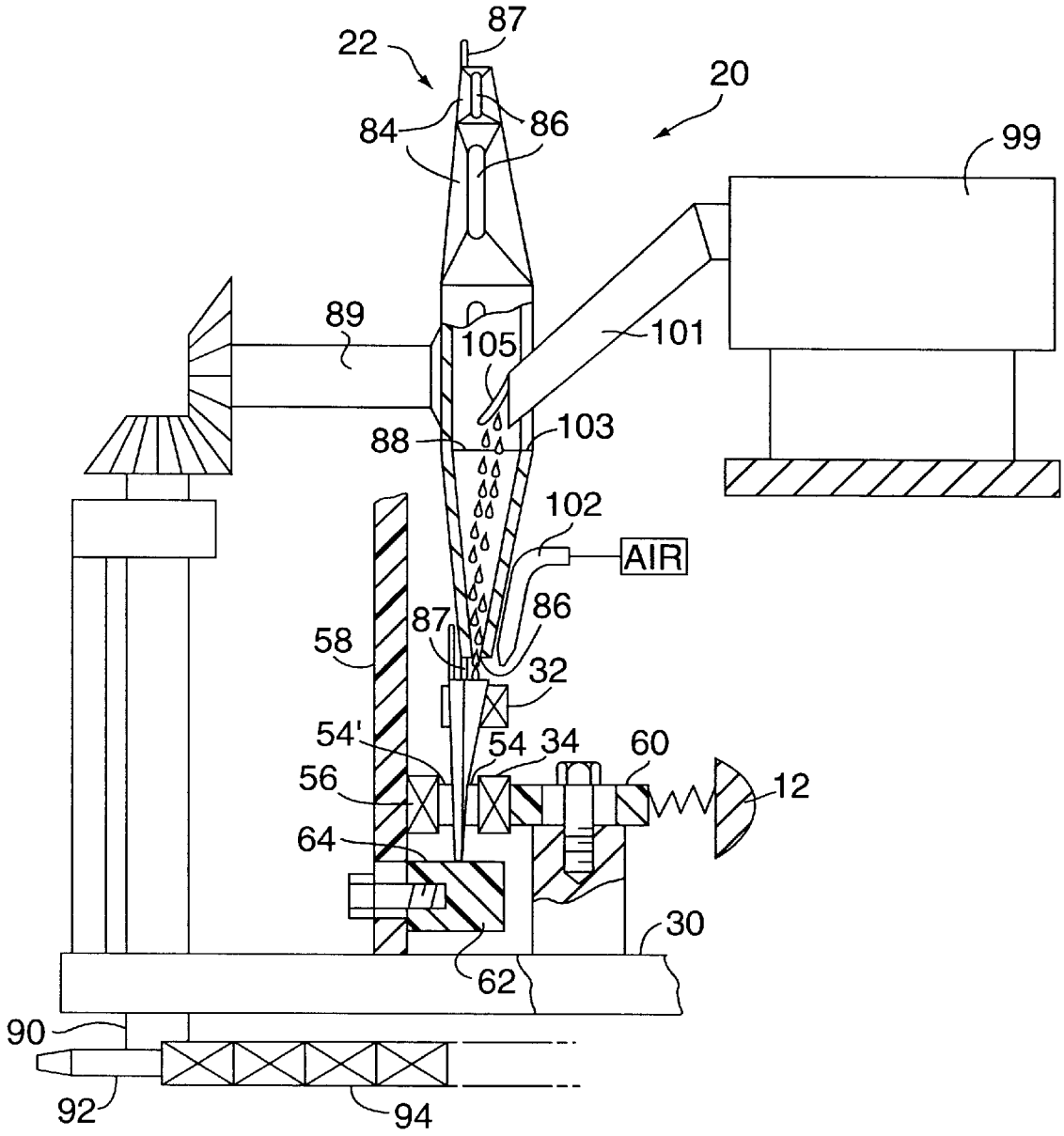
FIG. 8 is a somewhat schematic sectional view taken along the line 8—8 of FIG. 7.

A horizontally elongated support rail 62 which defines a horizontally disposed and upwardly facing packet supporting surface 64 is located below the lower conveyor chain 34 and the backup conveyor chain 56 as best shown in FIG. 7 and 8. The support rail is mounted on the backup wall 58 for vertical adjustment relative to the wall to adjust the vertical position of the packet supporting surface 64 relative to the upper and lower conveyor chains 32 and 34 and the backup conveyor chain 56.

Referring now particularly to FIGS. 1 and 2, the second conveyor 16 is mounted on and below a horizontal carrier plate 66 supported on stanchions (one shown in FIG. 1) above the base plate 30 and at a level above the level of the horizontally disposed first conveyor 14. The infeed end of the second conveyor 16 is disposed in slightly overlapping relation to the discharge end of the first conveyor 14, which discharge end is at the return end of the backup conveyor chain 56. The second conveyor 16 cooperates with the first conveyor 14 to define the predetermined path of packets P, P through the machine 10. More specifically, the second conveyor 16 is adapted to receive each successive packet P from the first conveyor 14, grip an upper portion of the packet at a position along its closed closure flap C and further advance the packet along a final portion of the predetermined path through the machine 10. The second conveyor 16 generally comprises an endless second conveyor chain 68 supported on the underside of the carrier plate 66 by a plurality of sprockets, which include idler, tension and drive sprockets, and travels in a generally rectangular path. The second conveyor 16 is driven in timed relation to the first conveyor by a drive sprocket 69 mounted on the main drive shaft 38 and coupled by a drive chain 71 to a driven shaft 73 and sprocket 75 associated with the second conveyor 16. The second conveyor chain 68 carries a series of spaced apart groups of discrete pressure pads 70, 70' for engaging each filled, closed and sealed seed packet along its closure flap C as the packet is further advanced by the second conveyor. A typical group of pressure pads shown in FIG. 14 includes 5 discrete pads, the outermost pads 70', 70' of the group having chamfered lower corners. A linear array of closely spaced rollers 72, 72 journalled on the carrier plate 66 for rotation about vertical axes are disposed adjacent the inner side of the second conveyor chain 68 along the rear run of the chain and provide backup for the second conveyor chain along a substantial portion of its rear run. The second conveyor 16 further includes an endless elastomeric belt 74 supported by crowned rollers 77, 77 to run in engagement with groups of pressure pads 70, 70' as the pressure pads travel along the rear run of the second conveyor chain 68. The elastomeric belt 74 is spring biased in a forward direction and toward engagement with the pressure pads 70, 70' carried by the rear run of the second conveyor chain 68, substantially as shown in FIG. 2. Thus, the overlapping first and second conveyors 14 and 16 which comprise the conveyor system define first and second portions of a predetermined path along which seed packets P, P are conveyed through the machine 10.

Preformed seed packets P, P contained in a supply magazine 76 at the packet feeding station 18 are successively withdrawn from the magazine by an electrically controlled pneumatically operated vacuum feeding device indicated generally at 78 which removes each successive packet P from the supply magazine 76, positions and releases the packet at a pick-up location in alignment with a nip at the in-feed end of the first conveyor 14 and in the path of upper and lower flights 52', 52 carried by the upper and lower conveyor chains 32 and 34. The piston/cylinder operated vacuum feeding device 78 is operated by a programmable logic controller (PLC) 80, shown in FIG. 1, in response to signals received from a rotary encoder 82 located below the base plate 30 and driven in timed relation to the conveyor system by the drive shaft 46, which drives the upper conveyor chain 32.

Seed is fed into each packet P from the seed distributor 22 which preferably comprises a rotary turret type distributor or funnel wheel journalled for rotation about a horizontal axis above the first conveyor 14. The presently preferred funnel wheel 22 (FIGS. 7 and 8) comprises a star-shaped wheel having coaxial circular front and rear walls and a circumaxial series of radially outwardly projecting funnels 84, 84 which converge radially outwardly to seed discharge openings 86, 86. Each funnel has a radially outwardly extending tab 87 at its outer or discharge end. The inner end of each funnel defines a seed receiving mouth 88 immediately adjacent and forming a junction with the mouth of the next successive funnel 84 in the circumaxial series. The rear wall of the funnel wheel 22 is mounted on and in coaxial alignment with an axially horizontal drive shaft 89 connected by bevel gears to a vertically oriented drive shaft 90 driven by a drive sprocket 92 located below the base plate 30. A drive chain 94 located below the base plate and engaged with the sprocket 92 and a drive sprocket 96 on the main drive shaft 38 (FIG. 1) drives the funnel wheel 22 in timed relation to the operation of the conveyor system. The drive chain 94 also engages a sprocket which drives the backup chain 56 in timed relation to the lower conveyor chain 34.

Seed is fed into the seed distributor or funnel wheel 22 from a vibratory feeder 99 of a well known type having a cylindrical feeder bowl including a spiral track and associated gates which direct seed from the bowl to and along the track into a chute 101 disposed between the vibratory feeder 99 and a circular seed receiving opening 103 in the circular front wall of the funnel wheel 22 as shown in FIG. 8. A lightweight flexible flap 105 at the discharge end of the chute 101 aids in controlling seed discharge from the chute into the funnel wheel 22.

The illustrated machine 10 also includes a packet opening device 98 (FIG. 7) for opening the mouth of each packet P to prepare the packet to receive seed from the funnel wheel. The presently preferred packet opening device comprises a first air supply tube 100 for directing a blast of air under pressure, received from a pressurized air supply source (not shown), downwardly and toward the mouth of each packet as the packet is advanced toward the funnel wheel 22 by the first conveyor 14.

A second air supply tube is preferably provided for directing a blast of air into each seed packet P while the packet is being filled by the funnel wheel, for a reason which will be hereinafter further discussed. The second air supply tube is shown in FIGS. 7 and 8 and indicated by the numeral 102. The air supply tube 102 is mounted in fixed position relative to the base plate 30, connected to a pressurized air supply source (not shown) and is or may be controlled by the PLC 80 to operate in timed relation to the seed feeding cycle of the funnel wheel 22 in response to signals from the rotary encoder 82.

Figure 9:
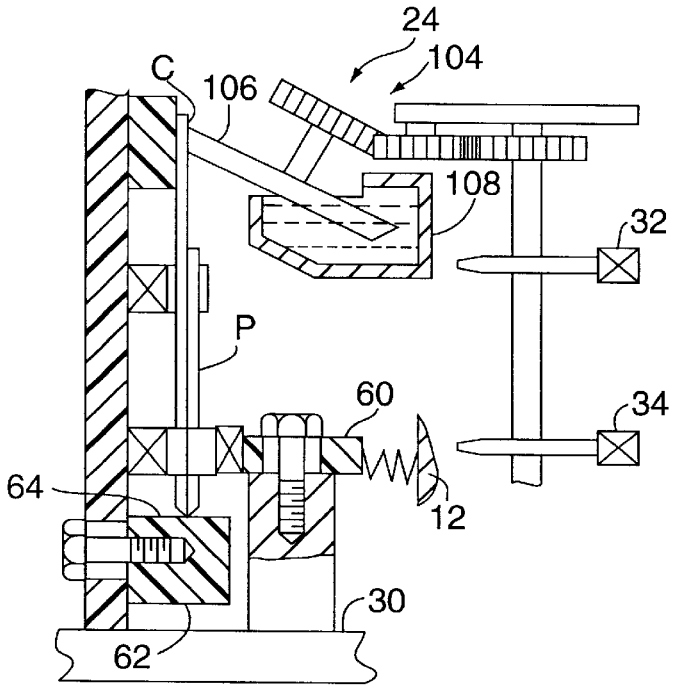
FIG. 9 is a somewhat enlarged schematic fragmentary view shown partially in section taken along the line 9—9 of FIG. 3
Figure 10:
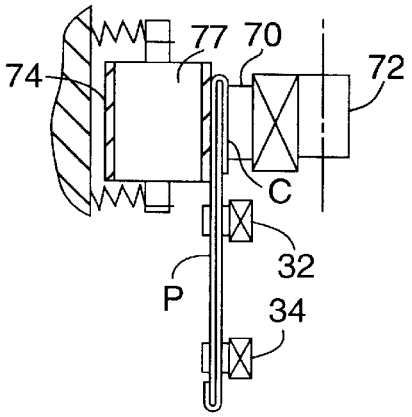
FIG. 10 is a somewhat enlarged fragmentary sectional view taken along the line 10—10 of FIG. 2.

The packet closing station 24 (FIG. 4) is located along the portion of the predetermined path defined by the first conveyor 14 and between the funnel wheel 22 and the second conveyor 16 for closing each filled packet as it is further advanced by the first conveyor 14. The presently preferred closure flap closing and sealing mechanism, located at the closing station 24, includes a glue applicator indicated generally at 104 for applying a stripe of liquid glue to the closure flap C of each packet as the closure flap passes through the flap closing station 24. The illustrated applicator 104, shown in FIGS. 4 and 9, has a driven glue applicator wheel 106 which receives liquid glue from a reservoir 108 and transfers the glue to the closure flap C of each advancing seed packet P. Referring particularly to FIG. 4 drive sprockets engaged with the upper and lower conveyor chains 32 and 34 drive a gear train which, in turn, rotates the glue applicator wheel 106 in timed relation to the operation of the first conveyor 14 so that the linear speed of the circumferential glue applicator surface of the applicator wheel 106 substantially equals the linear speed of the advancing conveyor 14. As the moving packet leaves the glue applicator 104 it encounters a plow 112 of a generally conventional type which engages the upwardly extending closure flap C to which glue has been applied and folds the closure flap in a forward and downward direction to a closed and sealed position in overlying engagement with the packet rear panel R.

Figure 14:
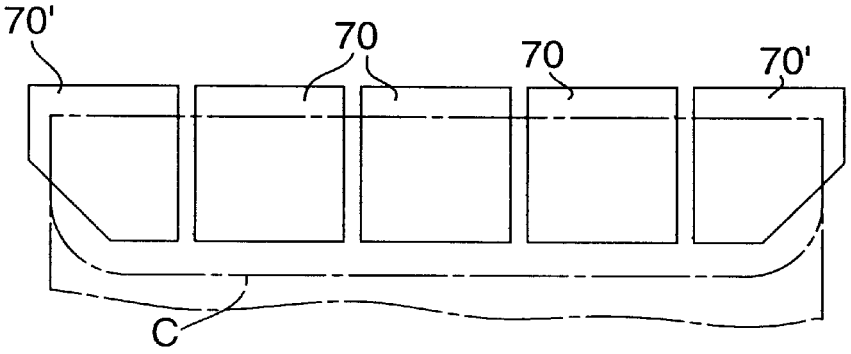
FIG. 14 is a somewhat enlarged schematic view showing the position of the pressure pads relative to a package closure flap, the closure flap being shown in phantom.

After leaving the closing station 24, the upper portion of the advancing closed packet P, which includes the closed closure flap C, enters the second conveyor 16 at a nip formed between a group of pressure pads 70, 70' carried by the rear run of the conveyor chain 68 and the elastomeric belt 74. The jaws 54, 54' on the first conveyor 14 separate releasing the packet P from the first conveyor 14 as the packet enters the nip of the second conveyor 16. As each filled and closed packet is advanced by the second conveyor 16 an associated group of pressure pads 70, 70' cooperate with the elastomeric belt 74 to apply sealing pressure to the packet closure flap C. The applied pressure may cause some glue to be extruded near the opposite ends of the closure flap; however, the chamfers on the end pads 70', 70' of the group, best shown in FIG. 14, provide end clearance to enable the pressure pads to avoid glue contamination.

The effective length of the second conveyor 16 is such that the portion of the conveyor which is operative to convey each packet allows time for the glue to dry while the closure flap is held in its sealed position by the conveyor. As each completed filled and sealed seed packet P approaches the discharge end of the second conveyor 16 the packet passes through the marking station 26 where a rotary printing mechanism 116 which operates in timed relation with the conveyor system applies desired indicia to the closed package. Such indicia may, for example, comprise a date code or lot number.

Figure 11:
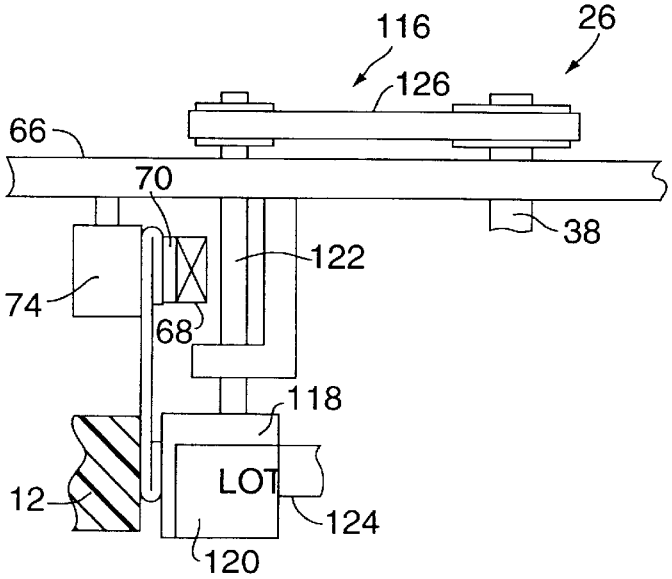
FIG. 11 is a somewhat enlarged schematic fragmentary elevation showing the marking station.
Figure 12:
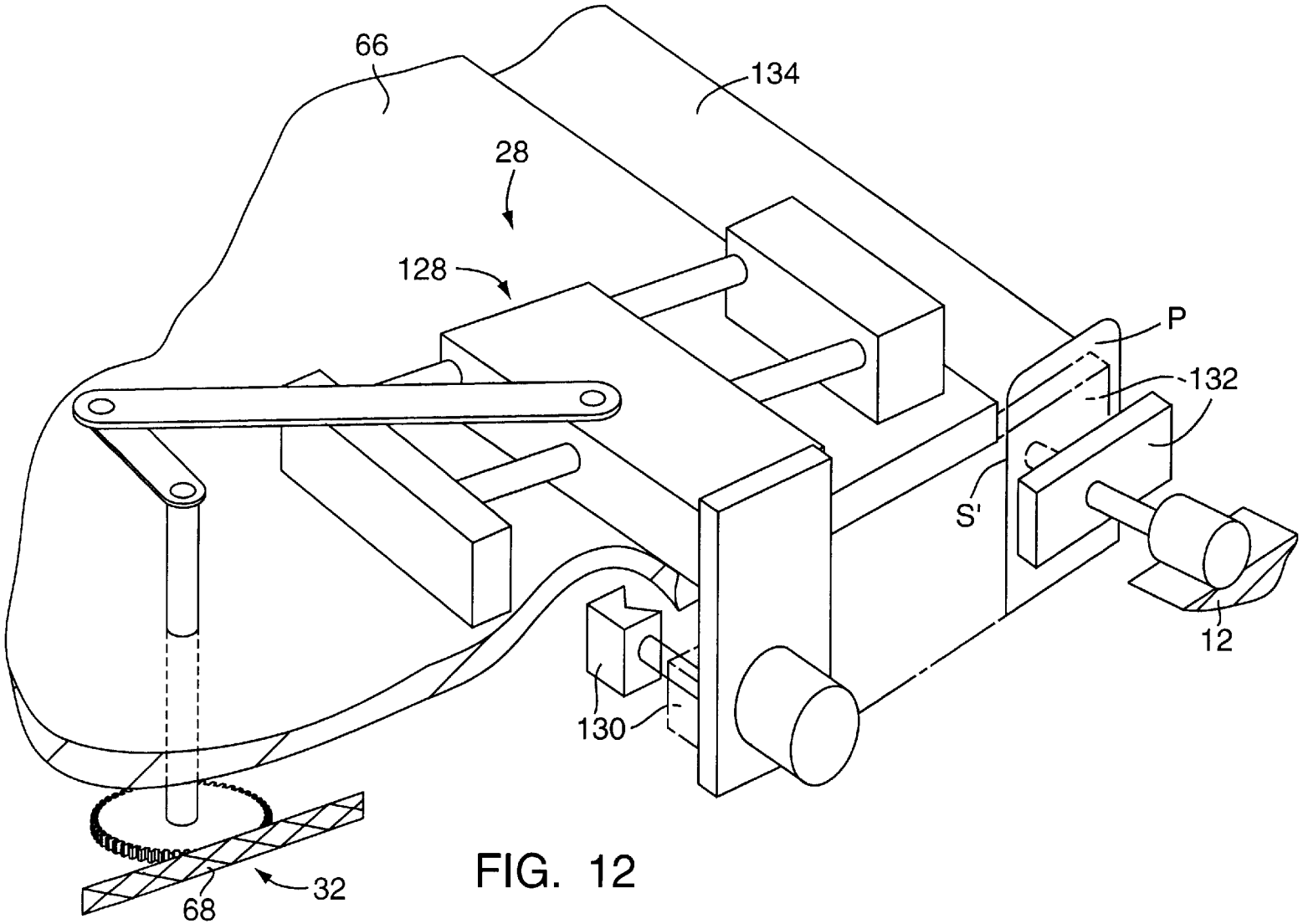
FIG. 12 is a somewhat enlarged schematic fragmentary perspective view showing the discharge station.
Figure 13:
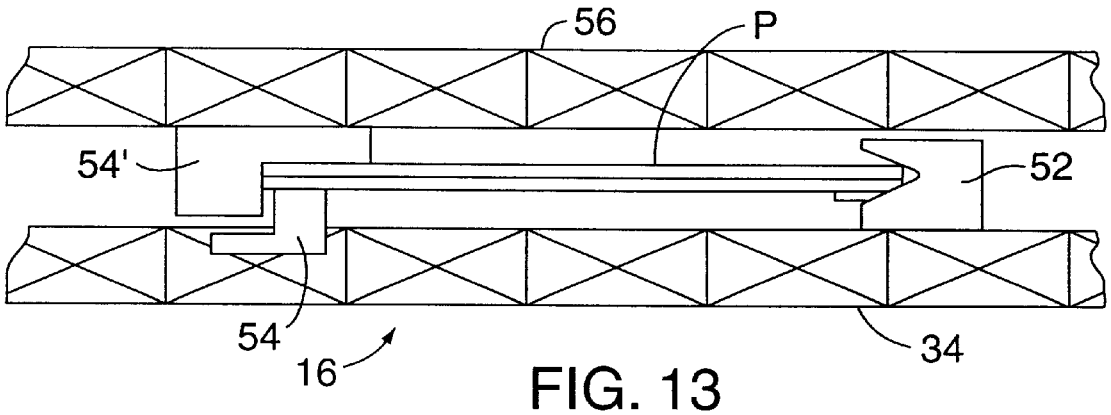
FIG. 13 is a somewhat enlarged schematic fragmentary sectional view taken along the line 13—13 of FIG. 7.

The rotary printing mechanism 116, shown somewhat schematically in FIG. 11, essentially comprises a printing cylinder 118 which carries a rubber printing die segment 120. The illustrated printing cylinder 118 is supported on a vertical drive shaft 122 journalled on the carrier plate 66 and may receive ink from any appropriate source, such as an inking pad indicated at 124. The illustrated printing cylinder is driven in timed relation with the second conveyor 16 by a timing belt 126 drivingly connected to the upper end of the main drive shaft 38. It will now be apparent that the marking station 26 may be located at any convenient position on the machine; however, it is preferably located near the discharge end of the machine to avoid risk of ink being smeared on the packets as the packets are advanced through the various work stations by the conveyor system.

As each filled, closed, and marked seed packet leaves the conveyor system at the discharge end of the second conveyor 16, it enters the discharge station 28 where a crank-operated slide mechanism, indicated generally at 128 and which carries a movable pusher 130, engages the trailing side edge S' of the packet to separate the packet from the conveyor flights. The crank-operated slide mechanism 128 operates continuously with a reciprocating motion. The pusher 130 carried by the slide mechanism is an electrically-controlled pneumatically-operated device which operates in response to signals from the PLC 80 to move the pusher 130, which travels with the slide, into and out of alignment with the trailing side edge S' of each successive packet as it leaves the second conveyor 16. The pusher 130 pushes the packet into the path of an electrically-controlled and pneumatically-operated ejector 132 which also operates in response to signals from the PLC and abruptly changes the direction of packet movement, causing each successive packet to move onto an independently-driven belt conveyor 134 located adjacent the end of the machine 10 as it leaves the machine. The belt conveyor 134 extends in a direction normal to the predetermined path of the packets through the machine 10 and carries each packet away from the machine and to an operator station (not shown) where the completed packets are or may be collected for packaging and shipment.

Preparatory to operating the machine 10, a quantity of preformed seed packages P, P are loaded into the supply magazine 76. A manually operable start button (not shown) energizes the DC drive motor 42 which places the conveyor system in operation. The programmable logic controller (PCL) 80 responds to a signal from the rotary encoder 82 to operate an air valve which controls the vacuum pick-up device 78 causing the pick-up device to withdraw a packet P from the supply magazine 76 and move the packet to and release it at the pick-up location at the in feed end of the first conveyor 14 where upper and lower flights 52, 52' on the upper and lower chains of the first conveyor 14 engage vertically spaced apart portions of the packet trailing side edge S'. As the packet P is advanced by the flights with its bottom edge B in sliding engagement with the packet supporting surface 64 a pair of opposing jaws 54, 54' carried by the lower conveyor chain 34 and its opposing backup conveyor chain 56 close on the packet and grip the packet at a predetermined position near its bottom B and leading side edge S. As the upwardly open preformed packet P is advanced by the first conveyor 14 it passes under the first air supply tube 100 which directs a blast of air under pressure toward and into the packet mouth M whereby the mouth is opened. The air control valve associated with the fist air supply tube 100 may be set to deliver a continuous blast of air or may be controlled by the PLC in timed relation to movement of the conveyor system to deliver a blast of air only when a packet is properly positioned to receive the air blast. As the packet, in opened mouth condition, approaches the funnel wheel 22 a tab 87 on one of the funnels enters the open mouth M and guides the funnel into said feeding position relative to the mouth. The tab also controls the packet closing flap C maintaining the flap in its upstanding position.

Upon initiation of the machine starting cycle the vibratory feeder commences to continuously feed seed into the funnel wheel 22 at a predetermined rate set by a manually controlled regulator (not shown). The seed feed rate may be regulated by the machine operator independent of other machine control functions. The required feed rate is generally determined by the type of seed to be packaged. As each funnel 84 moves angularly about the axis of the funnel wheel 22 and into, through and out of loading position relative to a seed packet P moving thereunder a generally predetermined quantity of seed is discharged from the funnel wheel and into the packet. It has been found that a reasonably accurate positive packaging tolerance can be maintained by establishing properly regulated settings for the vibratory feeder control regulator thereby avoiding the need for expensive weighing or measuring devices for controlling seed delivery. The presently preferred machine employs a funnel wheel which has 10 feeding funnels. It has been found that the angular movement of the funnel wheel in timed relation with the advancing movement of the conveyor system assures interruption of the flow of seed from each feeding funnel in the interval during which each packet is being moved into or out of seed receiving position relative to a funnel 84 by the advancing movement of the conveyor system. By regulating the feed rate of the vibratory feeder manually and independently of the operation of the machine, a trained machine operator may rapidly and accurately change the seed feeding rate so that changeover from packaging one type of seed to another may be accomplished with minimal machine down time. As seed is being discharged into a packet P from an associated funnel a blast of air is simultaneously directed into the open seed packet from the second air supply tube 102. The air flow into the packet aids in the flow of seed into the packet and toward the packet bottom and also assures that seed will not become lodged in an upper portion of a packet near a packet side edge which could interfere with proper package closure.

In accordance with presently preferred practice, liquid adhesive is applied to the envelope closing flap at the closing station 24 in the manner previously described. However, it should be understood that other closure flap sealing arrangements are possible and are contemplated within the scope of the present invention. Thus, for example, dry adhesive may be carried by a preformed envelope flap and activated at the closing station by the application of moisture using any appropriate applicator, including an applicator wheel of the aforedescribed general type. A spray-on adhesive may be applied to the closure flap at the closing station and such arrangement is also contemplated within the scope of the present invention.

After the closing flap C has been prepared for sealing the flap is moved to its closed position. A conventional plow is preferably employed to perform the flap closing operation, because a plow provides both positive and economical means for performing this function. The second conveyor applies sealing pressure to the closure flap after the flap has moved to its closed position relative to the packet. The marking or printing mechanism associated with the second conveyor 16 completes the packaging operation by applying such code information to each packet as may be necessary.

The PLC controls the package ejector which changes the direction of packet movement as the completed packet leaves the machine and enables provision of a machine of minimal length, thereby minimizing the machine footprint to conserve valuable floor space.

In addition to the features herein before described, the machine 10 may include other control functions. Thus, for example, a sensing device, such as a photoelectric cell, for example, may be employed for detecting an empty supply magazine condition and interrupting operation of the machine when such condition occurs. A sensing device of a similar type may also be provided to detect interruption of the ordinary flow of packets to the seed filling station and shut down the machine if such interruption should occur. A sensing device associated with the PLC may also be employed to monitor the ejection of packets from the machine.

I claim:

1. Apparatus for filling and closing preformed seed packets, each of the packets having front and rear panels connected together along bottom and side edges and defining an upwardly open packet mouth, the packet including a closure flap connected to an upper edge of one of the panels and extending upwardly therefrom, said apparatus comprising; a supply magazine for containing a quantity of preformed seed packets, packet feeding means for withdrawing each successive packet from said supply magazine and disposing the packet in a pick-up position, first conveying means for engaging the packet at said pick-up position, gripping a lower leading marginal edge portion of the packet and continuously advancing the packet along a predetermined path to and through a packet filling station, means for opening the packet mouth as the packet is continuously advanced by the first conveying means toward said packet filling station, seed dispensing means at said packet filling station for loading a predetermined quantity of seed into the packet through the packet mouth as the packet is continuously advanced along said predetermined path by said first conveying means, a closing station, flap closing means for moving the closure flap in a closed position as the packet is continuously advanced along said predetermined path from said packet filling station, and second conveying means cooperating with said first conveying means for receiving each successive filled and closed packet from said first conveying means, gripping an upper portion of said packet substantially along the entire length of its closed closure flap to and continuously urging the closure flap and holding it in its closed position while continuously advancing the packet along a further portion of said predeterminal path.

2. Apparatus for filling and closing preformed seed packets as set forth in claim 1 wherein said apparatus includes marking means for applying a code to the packet as the packet is moved along said predetermined path towards said discharge station by said conveying means.

3. Apparatus for filling and closing preformed seed packets as set forth in claim 1 including sealing means comprising a glue applicator for applying a strip of adhesive to the packet flap and a plow for moving said flap to a closed position in overlapping relation to an associated packet panel as the packet continuously advances along said predetermined path to and through said closing station.

4. Apparatus for filling and closing preformed seed packets as set forth in claim 1 including feeding means for continuously supplying seed to said seed dispensing means.

5. Apparatus for filling and closing preformed seed packets as set forth in claim 4 wherein said feeding means comprises a vibratory feeder having a feeder bowl for containing a quantity of seed and a chute for directing seed from said feeder bowl to said seed dispensing means.

6. Apparatus for filling and closing preformed seed packets as set forth in claim 5 wherein said seed dispensing means comprises a funnel wheel having a plurality of equiangularly spaced radially outwardly extending funnels mounted in fixed position relative to each other about a central axis and means for rotating said funnel wheel about said central axis to successively position each funnel at a loading position above an open packet in timed relation to advancement of each packet to said loading position by said first conveying means.

7. Apparatus for filling and closing preformed seed packets as set forth in claim 1 including a programmable controller for controlling operation of said apparatus.

8. Apparatus for filling and closing preformed seed packets as set forth in claim 7 wherein said programmable controller comprises a programmable logic controller operable in response to signals received from a signal generator operated by said conveying means.

9. Apparatus for filling and closing preformed seed packets as set forth in claim 8 wherein said signal generator comprises a rotary encoder.

10. Apparatus for filling and closing preformed seed packets as set forth in claim 1 wherein said seed dispensing means comprises a rotary funnel wheel journalled for rotation about a generally horizontal axis above-said first conveying means and having a cirumaxial series of radially outwardly projecting loading funnels each of said funnels having a discharge opening at the radial out end thereof and a mouth at the inner end thereof, said mouth of each of said funnels being immediately adjacent said mouth of a next successive funnel in the series, said funnel wheel having a radially disposed circular loading opening therein communicating with said mouth of each of said funnels, said seed distributing means further including a vibratory feeder having a feeder bowl including a discharge opening and a chute disposed between said discharge opening and said loading opening for receiving seed from seed vibratory feeder bowl and discharging seed into said funnel wheel through said discharge opening, and drive means for rotating said funnel wheel about its axis in timed relation to the movement of said first conveying means.

11. Apparatus for filling and closing preformed seed packets as set forth in claim 10 wherein said closing means comprises a plow.

12. Apparatus for filling and closing preformed seed packets as set forth in claim 10 including control means for operating said apparatus, said control mean including a rotary encoder driven in timed relation to the operation of said first conveying means and a programmable logic controller receiving signals from said rotary encoder to control the operation of said packet feeding means.

13. Apparatus for filling and closing preformed seed packets as set forth in claim 10 wherein said apparatus includes packet opening means disposed along said predetermined path between said packet feeding means and said seed dispensing means.

14. Apparatus for filling and closing preformed seed packets as set forth in claim 13 wherein said packet opening means comprises means for directing a jet of air under pressure toward the mouth of a packet being advanced by said first conveying means.

15. Apparatus for filling and closing preformed seed packets as set forth in claim 1 wherein said first conveying means comprises a first conveyor at one level and said second conveying means comprises a second conveyor located at another level above said one level and wherein said first conveyor has a discharge end and said second conveyor has an in-feed end disposed in overlapping relation to said discharge end.

16. Apparatus for filling and closing preformed seed packets as set forth in claim 15 wherein said second conveyor includes a series of spaced apart groups of discrete pressure pads and an endless elastomeric belt biased toward engagement with said pressure pads for engaging each filled and closed seed packet along its closure flap to urge the closure flap toward its closed position and further advance the packet along said predetermined path.

17. Apparatus for filling and closing preformed seed packets having front and rear panels connected together along bottom and side edges and having an upwardly open packet mouth and an upwardly extending closure flap connected to an upper edge of one of said panels, said apparatus comprising a supply magazine for containing a quantity of packets, packet feeding means for withdrawing each successive packet from said supply magazine and positioning the packet in a pick-up position, first conveying means for engaging each packet at said pick-up position, gripping the packet at a lower leading marginal edge portion thereof and continuously advancing the packet in an upwardly extending position along a predetermined path to and through a loading station, seed distributing means at said loading station for loading a generally predetermined quantity of seed into the packet and including a rotary funnel wheel journalled for rotation about a generally horizontal central axis above said first conveying means and having a circumaxial series of equangularly spaced radially outwardly projecting loading funnels supported in fixed position relative to each other about said central axis, each of said funnels having a discharge opening at a generally radially outer end thereof and a funnel mouth at a generally radially inner end thereof, said funnel mouth of each of said funnels forming a junction with a circumaxially adjacent said funnel mouth of a next one of said successive funnels in said series, said funnel wheel having a radially disposed coaxial circular loading opening therein communicating with said funnel mouth of each of said funnels, and drive means for rotating said funnel wheel about said central axis in timed relation to the movement of said first conveying means, flap closing means for moving the closure flap to a closed position as the filled packet is continuously advanced along said predetermined path from said packet filling station, and second conveying means driven in timed relation to said first conveying means for receiving each successive filled and closed packet and engaging the closing flap along a substantial portion of its entire length and urging the closure flap toward and holding it in its closed position while continuously advancing the filled and closed packet along a further portion of said predeterminal path.

18. Apparatus for filling and closing preformed seed packets as set forth in claim 17 wherein said apparatus includes printing means for applying a code to the packet as the packet is advanced by said conveying means.

19. Apparatus for filling and closing preformed seed packets as set forth in claim 18 wherein said printing means comprises a rotary printer associated with said second conveying means.

* * * * *